US009441447B2

(12) United States Patent
Cochran

(10) Patent No.: US 9,441,447 B2
(45) **Date of Patent: *Sep. 13, 2016**

(54) METHOD OF ISOLATING A WELLBORE WITH SOLID ACID FOR FRACTURING

(71) Applicant: SCHLUMBERGER TECHNOLOGY CORPORATION, Sugar Land, TX (US)

(72) Inventor: Jamie Cochran, Aberdeenshire (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 66 days.

This patent is subject to a terminal disclaimer.

(21) Appl. No.: 14/260,481

(22) Filed: Apr. 24, 2014

(65) Prior Publication Data

US 2015/0000911 A1 Jan. 1, 2015

Related U.S. Application Data

(63) Continuation-in-part of application No. 13/157,362, filed on Jun. 10, 2011, now Pat. No. 8,714,256.

(60) Provisional application No. 61/356,087, filed on Jun. 18, 2010.

(51) Int. Cl.
*E21B 33/12* (2006.01)

(52) U.S. Cl.
CPC ..... *E21B 33/1208* (2013.01); *E21B 33/12* (2013.01)

(58) Field of Classification Search
None
See application file for complete search history.

(56) References Cited

U.S. PATENT DOCUMENTS

| | | | | |
|---|---|---|---|---|
| 4,747,401 | A | 5/1988 | Potter et al. | |
| 4,848,467 | A | 7/1989 | Cantu et al. | |
| 4,957,165 | A | 9/1990 | Cantu et al. | |
| 4,986,355 | A | 1/1991 | Casad et al. | |
| 5,373,901 | A | 12/1994 | Norman et al. | |
| 5,497,830 | A | 3/1996 | Boles et al. | |
| 5,604,186 | A | 2/1997 | Hunt et al. | |
| 5,624,886 | A | 4/1997 | Dawson et al. | |
| 6,357,527 | B1 | 3/2002 | Norman et al. | |
| 6,446,727 | B1 | 9/2002 | Zemlak et al. | |
| 6,761,220 | B2 | 7/2004 | Blauch et al. | |
| 7,166,560 | B2 * | 1/2007 | Still | C09K 8/03 166/308.1 |
| 7,461,695 | B2 * | 12/2008 | Boney | E21B 33/12 166/278 |
| 7,677,312 | B2 | 3/2010 | Boney et al. | |
| 2004/0209780 | A1 | 10/2004 | Harris et al. | |
| 2007/0044966 | A1 | 3/2007 | Davies et al. | |
| 2011/0247812 | A1 | 10/2011 | Panga et al. | |

* cited by examiner

*Primary Examiner* — Doug Hutton, Jr.
*Assistant Examiner* — Silvana Runyan
(74) *Attorney, Agent, or Firm* — Jeremy D. Tillman; Mike Flynn; Tim Curington

(57) ABSTRACT

Apparatus and methods of treating a subterranean formation including introducing a coiled tubing string into a wellbore to a wellbore zone, wherein the string comprises a packer on a bottom hole assembly; introducing an acid fracture treatment through the string; introducing bridging fluid comprising particulates through the string; circulating a portion of fluid in the wellbore; introducing a final portion of fluid with a higher concentration of particulates to further form and consolidate bridge-packer, wherein the concentration of particulates in the final portion of fluid is higher than the introducing the bridging fluid comprising the particulates; squeezing the bridging fluid to isolate a perforation into the zone; moving the string to next zone; and repeating introducing and moving.

23 Claims, 2 Drawing Sheets

METHOD OF ISOLATING A WELLBORE WITH SOLID ACID FOR FRACTURING

PRIORITY

This application claims priority as a continuation-in-part application to U.S. Pat. No. 8,714,256 (scheduled to issue May 6, 2014), filed Jun. 10, 2011, entitled, "Method of Isolating a Wellbore with Solid Acid for Fracturing," which claims priority to U.S. Patent Provisional Application Ser. No. 61/356,087, filed Jun. 18, 2010, entitled, "Method of Isolating a Wellbore with Solid Acid for Fracturing," each of which is incorporated by reference herein in their entirety.

FIELD

Some embodiments relate to methods of creating a temporary packer and stimulating a subterranean formation using coiled tubing, foregoing the need for using inflatable straddle packers, or even sand packers.

BACKGROUND

In numerous wellbore environments, a variety of wellbore assemblies are used for well related activities. For example, assemblies may be used in many types of well related procedures, including well stimulation, cementing, water control treatments or other procedures. In many of these well applications, a packer is used to isolate a region of the wellbore in which the desired activity or operation is conducted.

In some applications, cup type downhole packers have been utilized, and in other applications, mechanical or hydraulic packers have been employed. Cup type downhole packers have an elastomeric sealing element designed to seal against a casing wall. However, the elastomeric sealing element is subject to wear due to this contact with the casing wall and/or contact with burrs along the inside of the casing left from the creation of perforations. Cup type packers also are prone to getting lodged in the wellbore, and they present additional problems in horizontal wells due to the natural positioning of the bottom hole assembly on a low side of the hole, leaving uneven clearance on the low side relative to the high side of the hole. Mechanical and hydraulic packers also are subject to wear and damage due to burrs left from casing perforation. Additionally, such packers are more complicated, expensive and prone to failure in a sand laden environment, while offering poor performance in open hole applications.

The use of an inflatable straddle packer can cause significant operational issues such as failing to set, unseating, parting and leaking. The challenges associated with these straddles are depth accuracy, hydraulic setting mechanism in sub-hydrostatic wells and poor tubular condition, tubing movement expansion and contraction of pipe during treatment, and waiting for packer elements to relax, which can cause resources and time in a treatment scenario.

Some packers are currently formed from particulate materials at desired locations in wellbores to isolate particular zones. However, in some applications, the material forming the packer is not readily removable and released after the particular activity is completed. Often, significant fluid pressure and volume is required to remove the packer. Further, in some instances, conventional sand plugs for zonal isolation (as used for proppant fracturing treatments) are not suitable as the sand would have potential to invade the matrix and reduce the permeability.

Thus the need exists for materials and methods of forming and easily removing wellbore packers which isolate wellbore zones.

FIGURES

Figure 2:
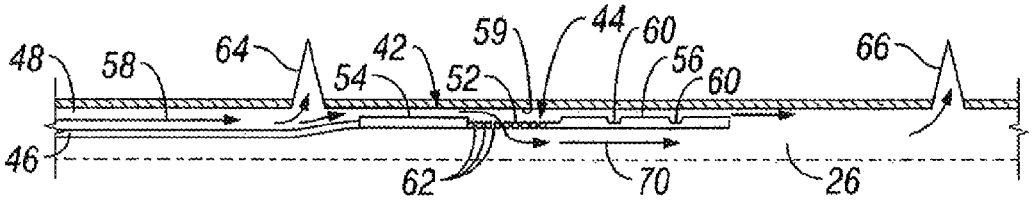
FIG. 2 is a schematic illustration of an embodiment of a portion of the wellbore assembly deployed at a location in the wellbore.
Figure 3:
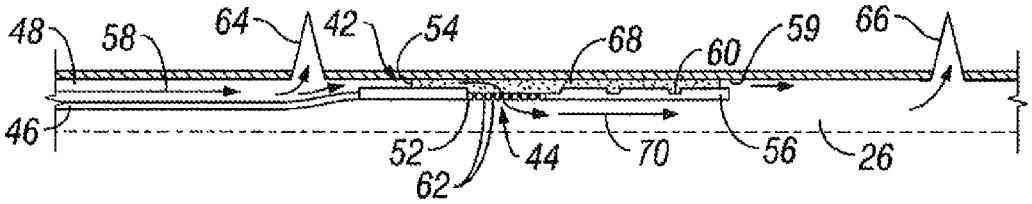
FIG. 3 is a schematic illustration of the embodiment illustrated in FIG. 2 with a packer formed.
Figure 4:
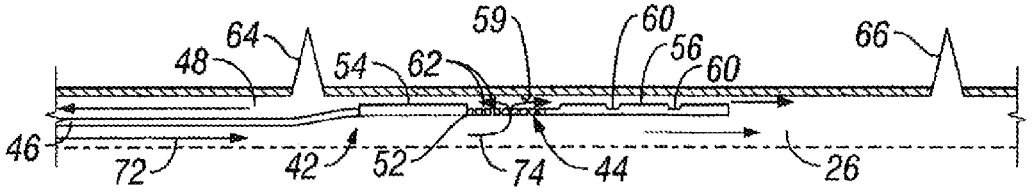

FIG. 4 differs from FIGS. 2 and 3 in that the particulate laden fluid is introduced into the wellbore through a coiled tubing conduit, as opposed to an annulus formed between the conduit and wellbore wall.

SUMMARY

Embodiments of the invention relates to apparatus and methods of treating a subterranean formation including introducing a coiled tubing string into a wellbore to a lowest wellbore zone, wherein the string comprises a single packer on a bottom hole assembly; setting a packer at the lowest zone; introducing an acid fracture treatment through the string at a single zone; introducing bridging fluid comprising polyacid particulates through the string; reducing fluid injecting to unset the packer; circulating a portion of fluid in the wellbore while moving the string in the wellbore; introducing a final portion of fluid with a higher concentration of polyacid particulates to further bridge packer formation and consolidation wherein the concentration of particulates in the final portion of fluid is higher than when introducing bridging fluid comprising polyacid particulates through the string; squeezing the bridging fluid to isolate a perforation into the zone; moving the string to next zone; and repeating introducing and moving.

DESCRIPTION

At the outset, it should be noted that in the development of any such actual embodiment, numerous implementation—specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary of the invention and this detailed description, each numerical value should be read once as modified by the term "about" (unless already expressly so modified), and then read again as not so modified unless otherwise indicated in context. Also, in the summary of the invention and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors possessed knowledge of the entire range and all points within the range.

The statements made herein merely provide information related to the present disclosure and may not constitute prior art, and may describe some embodiments illustrating the invention.

In general, some embodiments provide compositions for and methods of creating one or more packers at a desired location or locations within a wellbore for use in specific wellbore applications, in some instances deployed and used in conjunction with coiled tubing operations. Compared with conventional sand plugs, the particulate matter may have a greater tendency to readily form against the casing. A slurry of fluid medium with particulate matter is flowed downhole and then dehydrated, in some instances quickly hydrated using hydraulic pressure and/or mechanical force dispatched via coiled tubing, to form a temporary packer. At this location, the particulate matter, which is degradable and/or hydrolysable, is released from the fluid medium, deposited, and accumulated, while the fluid is routed to another location. The continual removal of fluid and consequent deposition and accumulation of particulate matter creates a packer at the desired location within the wellbore. Once the packer is established, a variety of wellbore treatments or other applications can be conducted in the well. The particulate matter, which is removable, is degradable and/or hydrolysable under certain conditions of temperature, time, pH, and pressure. Either simultaneous with or subsequent to a wellbore activity, the packer is partially or completely removed from the wellbore.

In one embodiment, a packer is formed in a wellbore penetrating subterranean by first flowing a slurry containing a fluid medium and a hydrolysable particulate matter, and then allowing accumulation of the hydrolysable particulate matter in the wellbore. The slurry is flowed from the wellhead to at least one position in the wellbore. In another embodiment, a degradable packer is formed in a wellbore by flowing a slurry of a fluid medium and particulate matter from the wellhead to at least one position in the wellbore, and the particulate matter accumulates at a position in the wellbore.

Embodiments generally to packers for wellbore applications in which the packer is partially or completely self removable by degradation and/or hydrolysis of the particle forming the packer. In some embodiments, the packer is generated in situ. This is accomplished by transporting a particulate matter to a wellbore zone or position to isolate, in a slurry form with a fluid medium, and accumulation the particulate matter. The accumulation may be accomplished by dehydrating the particulate matter. The fluid medium is separated from the particulate matter such that the particulate matter is deposited to generate the packer at the desired location or locations within the wellbore. As used herein, the term "dehydration" means substantially separating the fluid medium from the particulate matter, notwithstanding the actual composition of the fluid medium. Slurry dehydration may be accomplished by a variety of techniques, including taking a return flow of the fluid medium through the wellbore assembly tubing, e.g. coiled tubing, drill pipe or jointed tubing. The dehydration also may be created by a properly positioned choke, by creating a tight annular clearance, by a cup style packer, by combinations of these mechanisms or by other appropriate mechanisms, as described more fully below.

The packer may form by settling, or accumulation, of the particulate matter by a process of dehydrating the slurry. When the packer is formed from settling, or accumulation, a cup, choke, or other apparatus may optionally be provided which enhances or enables dehydration. The particulate matter may even accumulate or settle upon natural formations within the wellbore and/or adjacent subterranean formation. Also, the packer may be formed at a position within a wellbore where at least one perforation into the subterranean formation adjacent the wellbore has been made. The slurry may then be flowed from the wellhead to the perforation(s), and the packer forms through slurry dehydration by squeezing the fluid medium into the formation while substantially blocking movement of particulate matter into the formation. The dehydration may be accomplished using perforations in combination with any other dehydration mechanisms as well.

Simultaneous with, or subsequent to, a particular wellbore activity, the packer is self removed, as the particulate matter used to form the packer generally comprises an acid particle which degrades, clears, or releases upon exposure to particular factors. Also, eliminating the condition causing dehydration of the slurry may be used to assist in removing the packer.

The fluid medium used to form the packer may include a liquid, such as an aqueous liquid. In some embodiments, the fluid medium is simply any readily available aqueous liquid, water, or even aqueous brine. The density of the brine may be adjusted or tailored to match or approximate the density of the particulate matter. Also, the fluid medium may be a liquid mixed concomitantly with a gas component (most commonly nitrogen, carbon dioxide, argon, air or their mixtures) in the presence of a suitable surfactant, to form a fluid medium which is foam or an energized fluid. The dispersion of the gas component into the base fluid in the form of bubbles may increase the viscosity of the fluid medium thus impacting positively its transporting performance, for example, the capacity to carry particulate matter which forms a packer. The presence of the gas component may also enhance the flowback of the fluid medium from the wellbore, due to the expansion of such gas once the pressure is reduced.

As used herein, the term "liquid" is meant to include all components of the composition except any gas component. The term "gas component" is used herein to describe any component in a gaseous state or in a supercritical state, wherein the gaseous state refers to any state for which the temperature of the composition is below its critical temperature and the pressure of the composition is below its vapor pressure, and the supercritical state refers to any state for which the temperature of the composition is above its critical temperature. The terms "foam" and "energized fluid" are used interchangeably to describe any relatively stable mixture of gas component and liquid, notwithstanding the foam quality value, i.e. the ratio of gas volume to the total volume of gas component and liquid. In the art however, if the foam quality is above 52%, the fluid is conventionally called foam, and below 52%, an energized fluid. Since gas volume is known to decrease substantially with applied pressure and increase moderately with applied temperature, the resulting foam quality will also depend upon the temperature and pressure of the foam composition.

When a foamed fluid or energized fluid medium are used in some embodiments of the invention, a surfactant, or blend of surfactants, is useful for forming the foam. Any surfactant able to aid the dispersion and/or stabilization of the gas component into the fluid to form a foam that is readily apparent to those skilled in the art may be used. In some embodiments of the invention, the surfactant is an ionic surfactant. Examples of suitable ionic surfactants include, but are not limited to, anionic surfactants such as alkyl carboxylates, alkyl ether carboxylates, alkyl sulfates, alkyl ether sulfates, alkyl sulfonates, α-olefin sulfonates, alkyl phosphates and alkyl ether phosphates. Examples of suitable ionic surfactants also include, but are not limited to, cationic surfactants such as alkyl amines, alkyl diamines, alkyl ether amines, alkyl quaternary ammonium, dialkyl quaternary ammonium and ester quaternary ammonium compounds. Examples of suitable ionic surfactants also include, but are not limited to, surfactants that are usually regarded as zwitterionic surfactants and in some cases as amphoteric surfactants such as alkyl betaines, alkyl amido betaines, alkyl imidazolines, alkyl amine oxides and alkyl quaternary ammonium carboxylates. The amphoteric surfactant is a class of surfactant that has both a positively charged moiety and a negatively charged moiety over a certain pH range (e.g. typically slightly acidic), only a negatively charged moiety over a certain pH range (e.g. typically slightly alkaline) and only a positively charged moiety at a different pH range (e.g. typically moderately acidic), while a zwitterionic surfactant has a permanent positively charged moiety in the molecule regardless of pH and a negatively charged moiety at alkaline pH. In some embodiments of the invention, the surfactant is a cationic, zwitterionic or amphoteric surfactant containing an amine group or a quaternary ammonium group in its chemical structure ("amine functional surfactant"). A particularly useful surfactant is the amphoteric alkyl amine contained in the surfactant solution Aquat 944® (available from Baker Petrolite of 12645 W. Airport Blvd, Sugar Land, Tex. 77478). In other embodiments of the invention, the surfactant is a blend of two or more of the surfactants described above, or a blend of any of the surfactant or surfactants described above with one or more nonionic surfactants. Examples of suitable nonionic surfactants include, but are not limited to, alkyl alcohol ethoxylates, alkyl phenol ethoxylates, alkyl acid ethoxylates, alkyl amine ethoxylates, sorbitan alkanoates and ethoxylated sorbitan alkanoates. Any effective amount of surfactant or blend of surfactants may be used.

Fluids useful in embodiments may, or may not, also include a viscosifier that may be a polymer that is either crosslinked or linear, a viscoelastic surfactant, or any combination thereof. Some nonlimiting examples of suitable polymers include guar gums, high-molecular weight polysaccharides composed of mannose and galactose sugars, or guar derivatives such as hydroxypropyl guar (HPG), carboxymethyl guar (CMG), and carboxymethylhydroxypropyl guar (CMHPG). Cellulose derivatives such as hydroxyethylcellulose (HEC) or hydroxypropylcellulose (HPC) and carboxymethylhydroxyethylcellulose (CMHEC) may also be used. Any useful polymer may be used in either crosslinked form, or without crosslinker in linear form. Xanthan, diutan, and scleroglucan, three biopolymers, have been shown to be useful as viscosifying agents. Synthetic polymers such as, but not limited to, polyacrylamide and polyacrylate polymers and copolymers are used typically for high-temperature applications. Nonlimiting examples of suitable viscoelastic surfactants useful for viscosifying some fluids include cationic surfactants, anionic surfactants, zwitterionic surfactants, amphoteric surfactants, nonionic surfactants, and combinations thereof. Also, associative polymers for which viscosity properties are enhanced by suitable surfactants and hydrophobically modified polymers can be used, such as cases where a charged polymer in the presence of a surfactant having a charge that is opposite to that of the charged polymer, the surfactant being capable of forming an ion-pair association with the polymer resulting in a hydrophobically modified polymer having a plurality of hydrophobic groups, as described in published application U.S. 20040209780A1, Harris et. al.

Methods and compositions of the invention are useful for forming packers for conducting activities in vertical and horizontal wellbores. Prior to, during or after creation of the packer, additional aspects of the wellbore application can be conducted. For example, restimulation, perforation procedures, formation stimulation techniques, acidizing, cementing applications, lost circulation control, or water control treatments can be accomplished.

The ability to generate the packer enables adaptation of the packer to casing size and condition variations as well as to open hole applications or applications within external screens or other tubular components. Also, the packer is self-healing in the sense that the packer continues to build as long as particular matter is transported to the desired area. Multiple packers can be generated with a single trip into the wellbore thus saving costs and often simplifying the procedure. For example: a BHA initially can be moved to a desired location in wellbore; a packer is then built; a well related procedure is carried out; the BHA is then moved to another location; another packer is built; a subsequent well related procedure is carried out; and this process is repeated as many times as desired during the single trip into the wellbore. The packer can be a single entity, separating the upper well region from the lower well region, or could be a straddle system, where two separate entities isolate an interval from both the upper well region and lower well region.

In some embodiments, the particulate matter used to form the packer comprises a solid acid particle which degrades, melts, hydrolyzes, or releases upon exposure to particular factors. Such factors include, but are not necessarily limited to time, temperature, pressure, hydration, or pH. As used herein, the term "acid particle" means an acid material which may be an acid monomer in an amorphous or crystalline solid state (solid acid), an acid contained within an solid capsule, shell, or coating (encapsulated acid), and the like. An acid particle may also comprise a polyacid in a solid form, amorphous or crystalline, which is the condensation product of certain organic acid precursors (acid monomers). Such organic acids are condensed by removal of water to form the polyacid.

The acid particle matter may be of any suitable particle size, range of particle size, grade of particles, or plurality of particle sizes, ranges, or grades, to achieve packers according to the invention. For example, a 20 mesh particle could be blended with a 40 mesh particle to achieve packers with unique strength, size, degradation, or other properties. In some other aspects the acid particle matter may be in any shape: for example, powder, particulates, chips, fiber, bead, ribbon, platelet, film, rod, strip, spheroid, toroid, pellet, tablet, capsule, shaving, any round cross-sectional shape, any oval cross-sectional shape, trilobal shape, star shape, flat shape, rectangular shape, cubic, bar shaped, flake, cylindrical shape, filament, thread, or mixtures thereof. The degradable or dissolvable materials are solid materials, either amorphous or/and crystalline in nature, and generally are not traditional liquid materials. The density of the acid material may be of any suitable value, but may range from below about 1 to about 4 g/cm$^3$ or more. The materials may be naturally occurring and synthetically prepared, or mixture thereof. These degradable or dissolvable materials may even be biodegradable or composed of synthetic organic polymers or elastomers, as well as particular inorganic materials, or any mixtures of such materials. The degradable or dissolvable materials are preferably present in the treatment fluid as a finely divided or dispersed material, while not used as a bulk phase or solid bulk form.

In some cases, the particulate matter may be comprised of a plurality of particle size distributions, such as those described in U.S. Pat. No. 7,677,312, or U.S. patent application Ser. No. 12/758,155 titled "Methods to Gravel Pack a Well Using Expanding Materials," both of which are incorporated herein by reference in their entirety. Although not limiting in any way, the concept is incorporating a first amount of particulate matter, and a second amount of particulate matter into a treatment fluid, wherein the first amount of particulates have a first average size distribution and the second amount of particulates have a second average size distribution (a so called "bimodal" distribution). In another aspect, a first amount of particulates, a second amount of particulates, and a third amount of particulates may be used, wherein the first amount of particulates have a first average size distribution, the second amount of particulates have a second average size distribution, and the third amount of particulates have a third average size distribution (a so called "trimodal" distribution). In some cases the first average size distribution is at least two times larger than the second average size distribution, and second average size distribution is at least two times larger than the third average size distribution where applicable.

Polyacid particles useful in some embodiments of the invention may be solid acids or encapsulated acids. Any suitable acid may be used. Examples of suitable acids for forming acid particles of the invention, which may be either solid acids or encapsulated acids, include, but are not limited to, hydrochloric acid, sulfuric acid, phosphoric acid, phosphoric acid, nitric acid, formic acid, acetic acid, sulfamic acids, citric acid, glycolic acid, maleic acid, boric acid, oxalic acid, sulfamic acid, furmaric acid, lactic acid, other mineral acids, other organic acids, and the like. Sulfamic acid, boric acid, citric acid, oxalic acid, maleic acid, and the like, are some examples of suitable solid acids forming solid acid particles. When encapsulated, the acids may be encapsulated in accordance with the methods described in U.S. Pat. Nos. 5,373,901, 5,604,186, and 6,357,527 and U.S. patent application Ser. No. 10/062,342, filed on Feb. 1, 2002 and entitled "Treatment of a Well with an Encapsulated Liquid and Process for Encapsulating a Liquid," each of which is incorporated by reference herein in its entirety.

Processes for encapsulating solids are well known. For example, some encapsulated solids such as encapsulated citric acid are readily available from the Balchem Corporation, P.O. Box 175, Slate Hill, N.Y. 10973 (Balchem). Three versions for use in some embodiments include CAP-SHURE® CITRIC ACID C-165-85, CAP-SHURE® CITRIC ACID C-165-63 and CAP-SHURE® CITRIC ACID C-150-50. Each product has a semi-permeable membrane formed from partially hydrogenated vegetable oil. The semi-permeable membrane has a melting point ranging from 59° C. to 70° C.

Some acid particles useful in some embodiments of the invention hydrolyze under known and controllable conditions of temperature, time and pH to evolve the organic acid precursors. Any acid particle which is prone to such hydrolysis may be selected for some embodiments. One example of a suitable acid particle is a solid polyacid formed from the solid cyclic dimer of lactic acid (known as "lactide"), which has a melting point of 95 to 125° C., (depending upon the optical activity). Another is a polymer of lactic acid, (sometimes called a polylactic acid (or "PLA"), or a polylactate, or a polylactide). Another example is the solid cyclic dimer of glycolic acid (known as "glycolide"), which has a melting point of about 86° C. Yet another example suitable as solid acid-precursors are those polymers of hydroxyacetic acid (glycolic acid) ("PGA"), with itself or other hydroxy-, carboxylic acid-, or hydroxycarboxylic acid-containing moieties described in U.S. Pat. Nos. 4,848,467; 4,957,165; and 4,986,355. Another example is a copolymer of lactic acid and glycolic acid. These polymers and copolymers are polyesters. A particular advantage of these materials is that the solid polyacids and the generated acids are non-toxic and are biodegradable. The solid polyacids are often used as self-dissolving sutures.

The polyacid particles may be coated to slow hydrolysis in order to delay degradation until the slurry has formed the packer. Such coating materials are widely known in the art. See U.S. Pat. Nos. 4,741,401, 5,497,830 and 5,624,886, incorporated herein by reference. Suitable coatings include, by non-limiting example, polycaprolate (a copolymer of glycolide and epsilon-caprolactone), and calcium stearate, both of which are hydrophobic. Polycaprolate itself slowly hydrolyzes. Generating a hydrophobic layer on the surface of the acid particle, or solid acid-precursor, by any means delays the hydrolysis. Note that coating here may refer to encapsulation or simply to changing the surface by chemical reaction or by forming or adding a thin film of another material. The hydrolysis of the acid particle does not substantially occur until at least the time water contacts the acid particle.

Mixtures of one or more acid particles may be purely physical mixtures of separate particles of separate components. The mixtures may also be manufactured such that one or more acid particle and one or more solid acid-reactive materials is in each particle; this will be termed a "combined mixture". This may be done, by non-limiting example, by coating the acid particle material with a solid acid-precursor, or by heating a physical mixture until the solid acid-precursor melts, mixing thoroughly, cooling, and comminuting. For example, it is common practice in industry to co-extrude polymers with mineral filler materials, such as talc or carbonates, so that they have altered optical, thermal and/or mechanical properties. Such mixtures of polymers and solids are commonly referred to as "filled polymers". In any case it is preferable for the distribution of the components in the mixtures to be as uniform as possible. The choices and relative amounts of the components may be adjusted for the situation to control the acid particle hydrolysis rate.

The amount of acid particle, or mixture, used in the particulate matter will be dependent upon the particular requirements and environment presented. The particulate matter may comprise any suitable amount of acid particles, and is mixed with the fluid medium to form the slurry. The fluid medium is typically any aqueous medium readily available at the job site. The preferred concentration range of acid particles is between from about 0.4 ppg and about 8.3 ppg (between about 0.05 and about 1.0 kg/L). The most preferred range is between about 0.8 ppg and about 2.5 ppg (between about 0.1 and about 0.3 kg/L). One skilled in the art will know that for a given particle shape, flow rate, rock properties, etc. there is a concentration, that can be calculated by one of ordinary skill in the art, at which the packer will be formed.

The degradation of acid particles may also be accelerated or delayed by the addition of certain soluble liquid additives.

These accelerants may be acids, bases, or sources of acids or bases. These are particularly valuable at low temperatures (for example below about 135° C.), at which solid acid-precursors, for example, hydrolyze slowly, relative to the time an operator would like to put a well on production after a fracturing treatment. Non-limiting examples of such soluble liquid additives that hydrolyze to release acids are esters (including cyclic esters), diesters, anhydrides, lactones and amides. A compound of this type, and the proper amount, that hydrolyzes at the appropriate rate for the temperature of the formation and the pH of the fracturing fluid is readily identified for a given treatment by simple laboratory hydrolysis experiments. Other suitable soluble liquid additives are simple bases. (They are termed "liquids" because in practice it would be simpler and safer to add them to the fluid medium as aqueous solutions rather than as solids.) Suitable bases are sodium hydroxide, potassium hydroxide, and ammonium hydroxide. Other suitable soluble such as alkoxides, carbonates, sulfonates, phosphates, and bicarbonates, as well as alcohols such as but not limited to methanol and ethanol, alkanol amines and organic amines such monoethanol amine and methyl amine, may be used. Other suitable soluble liquid additives are acids, such as but not limited to, aminopolycarboxylic acids (such as but not limited to hydroxyethyliminodiacetic acid), polyaminopolycarboxylic acids (such as but not limited to hydroxyethylethylenediaminetriacetic acid), salts—including partial salts—of the organic acids (for example, ammonium, potassium or sodium salts), and mixtures of these acids or salts. The organic acids may be used as their salts. When corrosive acid might contact corrodible metal, corrosion inhibitors are added.

In addition to acid particles, the particulate matter may also comprise other suitable materials to form the packer. Examples of such materials include, but are not limited to, sand, walnut shells, sintered bauxite, glass beads, ceramic materials, naturally occurring materials, or similar materials. Mixtures of any of these may be used as well. If sand is used, it will typically be from about 20 to about 100 U.S. Standard Mesh in size. Naturally occurring materials may be underived and/or unprocessed naturally occurring materials, as well as materials based on naturally occurring materials that have been processed and/or derived. Suitable examples of naturally occurring particulate materials for use include, but are not necessarily limited to: ground or crushed shells of nuts such as walnut, coconut, pecan, almond, ivory nut, brazil nut, etc.; ground or crushed seed shells (including fruit pits) of seeds of fruits such as plum, olive, peach, cherry, apricot, etc.; ground or crushed seed shells of other plants such as maize (e.g., corn cobs or corn kernels), etc.; processed wood materials such as those derived from woods such as oak, hickory, walnut, poplar, mahogany, etc. including such woods that have been processed by grinding, chipping, or other form of particalization, processing, etc.

Figure 1:
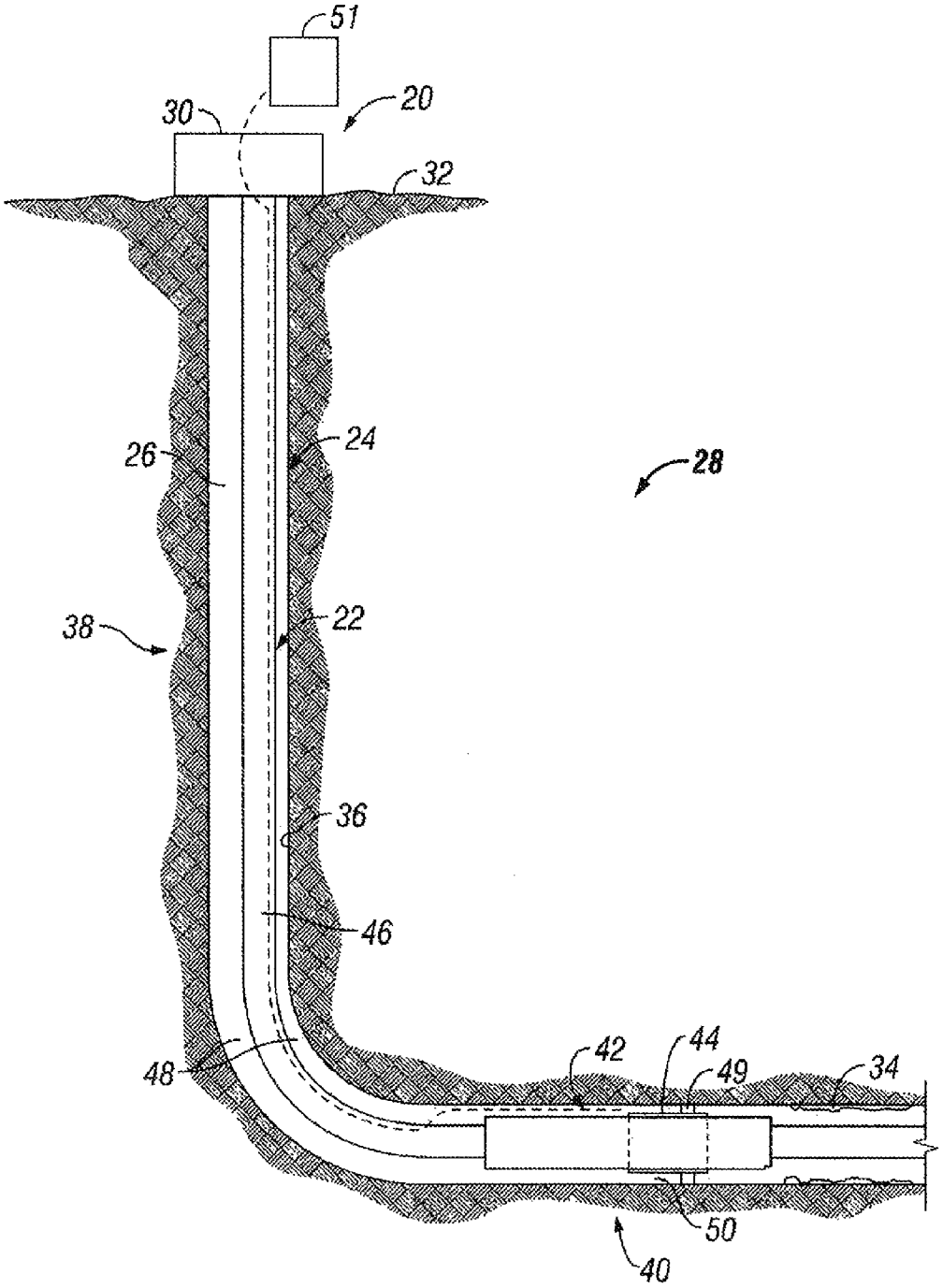
FIG. 1 is a front elevation view of a wellbore assembly disposed in a wellbore.

Referring now generally to FIG. 1, a system 20 is illustrated according to an embodiment of the present invention. In the particular embodiment illustrated, system 20 comprises a wellbore assembly 22 disposed in a well 24 formed by a wellbore 26 drilled into a formation 28. Formation 28 may hold desirable production fluids, such as oil. Wellbore assembly 22 extends downwardly into wellbore 26 from a wellhead 30 that may be positioned along a surface 32, such as the surface of the earth or a seabed floor. The wellbore 26 may comprise open hole sections, e.g. open hole section 34, cased sections lined by a casing 36, or a combination of cased sections and open hole sections. Additionally, wellbore 26 may be formed as a vertical wellbore or a deviated, e.g. horizontal, wellbore. In the embodiment illustrated in FIG. 1, wellbore 26 comprises a vertical section 38 and a deviated section 40 which is illustrated as generally horizontal. Packers can be generated in either or both vertical sections and deviated sections of wellbore 26.

In the example illustrated, wellbore assembly 22 comprises an operational assembly 42, such as a bottom hole assembly, having a dehydration device 44. Wellbore assembly 22 supports the dehydration device 44 on a tubing 46, such as coiled tubing, drill pipe or jointed tubing. The wellbore assembly 22 creates a surrounding annulus 48 that extends, for example, along the exterior of at least tubing 46 and often along at least a portion of operational assembly 42 to dehydration device 44. The dehydration device 44 may comprise a variety of mechanisms or combinations of mechanisms 49. Examples of mechanisms 49 include chokes, screens, cup style packers, annular orifices, sealing elements, a tighter clearance 50 between the dehydration device and a surrounding wall, and other mechanisms able to direct the slurry flow such that fluid medium is separated from the particulate matter. For example, the dehydration device can be used to create a pressure drop that encourages fluid flow through a screen sized to block particular matter in the slurry.

Well related parameters can be tracked by a control system 51, such as a computer-based control system. Control system 51 can be used to collect data, such as temperature and pressure data, in real-time. The data is collected from the well to provide an indication or roadmap as to the progress of various procedures. For example, control system 51 can be used to monitor the creation and elimination of packers at multiple levels within the wellbore.

It should be noted that use of the terminology down, downward, downwardly or up, upward or upwardly reflects relative positions along wellbore 26. Regardless of whether the wellbore is vertical or horizontal, down, downward or downwardly mean further into the wellbore relative to wellhead 30, and up, upward or upwardly mean a position along the wellbore that is closer to the wellhead 30 relative to a given reference point.

In the embodiment illustrated in FIG. 2, dehydration device 44 comprises a screen 52 positioned between a pack seal area 54 and a choke 56. Effectively, dehydration device 44 comprises screen 52 and choke 56 which cooperate to separate slurry 58. The slurry, indicated by arrow 58, is formed of a fluid medium and particulate matter that is flowed downwardly through annulus 48 along tubing 46 and pack seal area 54. The annulus 48 is defined at its exterior by a wall 59 that may be formed by the formation in an open hole section, by casing 36, by an outlying screen section, such as a gravel pack screen, or by another surface radially spaced from and surrounding at least a portion of operational assembly 42.

As the slurry 58 flows along screen 52, the fluid medium portion moves through screen 52 causing the consequent deposition of particulate matter. Some of the slurry also may flow past screen 52, but choke 56 is designed to create a pressure drop that encourages flow through screen 52 rather than flow down the annulus surrounding choke 56. A plurality of annular rings 60 can be formed in choke 56 to further encourage passage of the fluid medium through screen 52. In this embodiment, screen 52 comprises openings 62 that allow the fluid to pass through while preventing the particulate matter from entering the inside of the screen. In this application, dehydration device 44 is positioned between an upper perforation 64 and a lower perforation 66.

Once dehydration device 44 is positioned at a desired location within wellbore 26, slurry 58 is flowed downwardly through annulus 48 and a packer 68 begins to build over choke 56, as illustrated in FIG. 3. The packer 68 then continues to expand upward to cover screen 52 and then pack seal area 54. When dehydration device 44 is located in a horizontal or other type of deviated wellbore, packer 68 continues to build as long as the flow velocity over pack seal area 54 is sufficient to carry sand to the top of the packer. In this embodiment, slurry 58 is delivered to the desired area along a first flow path, and the separated fluid medium is directed along a second flow path which is routed downwardly through assembly 42, as indicated by arrows 70. Or as shown in FIG. 4, the flow can be redirected back up the conduit 46, and following the flow path as indicated by 72. As the packer builds, fluid medium flow through the packer is reduced. Packer 68 is readily built in several types of locations, including in an annulus defined on its exterior by an open hole section, a cased section or a screen section, e.g. a gravel pack screen.

Before, during and/or after generation of packer 68, other aspects of the wellbore application can be completed. For example, perforation procedures (normally done before generation of packer 68), formation stimulation techniques, cementing applications, or water control treatments can be implemented. When the application at that wellbore location is completed, packer 68 can be eliminated, and assembly 42 can be withdrawn from the wellbore or moved to another location in the wellbore for creation of another packer 68. The ability to generate and eliminate packers enables multi-layer applications within a wellbore without removal of wellbore assembly 22.

Thus, various well related procedures can be carried out in different zones between or during the sequential building of packers along the wellbore. For example, packer 68 can be formed at one location to enable treatment of the well interval. The packer is then cleared, and assembly 42 is moved to the next desired wellbore location, e.g. an adjacent zone. At that location, another packer 68 is formed and a well treatment is carried out. Packer 68 can be repeatedly formed and unset at multiple locations, e.g. levels, within the well.

As mentioned above, the degradation characteristic of some acid particles makes time-release packers possible. For example, the packer 68 can be formed in the wellbore. Then after exposure over time to certain factors, i.e. water in the presence or temperature, the packer 68 begins to degrade, ultimately releasing. Formation and time-release of packer 68 may also be conducted for a plurality of zones, either simultaneously or concurrently.

According to one method, assembly 42 is moved downhole to a desired perforation location. A perforation tool is then used to form perforations, followed by the building of packer 68 below the perforations. Subsequently, a fracturing procedure or other procedure is performed. Once the procedure is completed, assembly 42 is moved to another wellbore location, e.g. a location upward from the previously formed perforations, and the perforation tool is used again to form perforations in another zone. Another packer 68 is built below the perforations, and a procedure such as fracturing is carried out. This process can be repeated at multiple zones. It should be noted that in some applications, packer 68 is washed or flushed away at least partially before moving assembly 42.

In one method embodiment, a technique for well re-stimulation acid fracturing is disclosed wherein the bridging fluid forming a temporary bridge includes particulate matter comprises a trimodal distribution of particle sized PLA polyacid particles, primarily in the shape of fibers, and the aqueous fluid medium contain the particulate has an appropriate viscosity for carrying the particulate matter (optionally viscosified by a polymer or viscoelastic surfactant). The aqueous fluid is a brine with density tailored for neutral buoyancy (for instance, about 1.2-1.3 g/cm$^3$) with the particulate matter. First, (1), a coiled tubing (CT) string is run in hole to lowest zone at the toe, and the CT string comprises a single multi-set frac packer on the bottom hole assembly (BHA). (2) A packer is set, and (3) a high rate acid fracture treatment (pad and acid) is performed at a single zone through the CT string. (4) A tail of fluid containing polyacid particulates (with packer still set) is pumped until the fluid reaches near the matrix formation (intentionally creating mini screen out). (5) Fluid pumping is momentarily reduced or stopped to unset the packer. (6) A portion of bridging fluid is circulated in the wellbore whilst slowly pulling out of hole (POOH), and a final tail bridging fluid with increased fibres is pumped to further bridge formation and consolidation. (7) The bridging fluid is then squeezed to isolate perforation into zone. (8) The CT string is then pulled up to next zone. (9) Steps 2-7 are repeated as many times as desired. (10) The CT string is POOH, and/or alternatively, a high pH fluid is circulated whilst running in hole (RIH) to accelerate dissolution of the PLA polyacid particles forming the bridge. Then, (11) completely allow the PLA polyacid particles to hydrolise and begin formation fluid production.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

I claim:

1. A method of treating a subterranean formation, comprising:

(i.) introducing a coiled tubing string into a wellbore to a first wellbore zone,
wherein the string comprises a packer on a bottom hole assembly;

(ii.) introducing an acid fracture treatment through the string;

(iii.) introducing an initial portion of a bridging fluid comprising particulates through the string;

(iv.) circulating a portion of a treatment fluid in the wellbore;

(v.) introducing a subsequent portion of the bridging fluid having a higher concentration of the particulates than the initial portion of the bridging fluid to form and consolidate a bridge-packer;

(vi.) squeezing the bridging fluid to isolate a perforation into the first wellbore zone;

(vii.) moving the string to a second wellbore zone; and (viii.) repeating steps (ii.)-(vii.) until treatment is complete.

2. The method of claim 1, wherein the particulate is an acid particle.

3. The method of claim 1, wherein the particulate is a solid acid particle or an encapsulated acid.

4. The method of claim 1, further comprising circulating a pH fluid whilst running in hole to accelerate dissolution of the particulates.

5. The method of claim 1, wherein the particulates comprise a first amount of particulates, and a second amount of particulates, wherein the first amount of particulates have a first average size distribution and the second amount of particulates have a second average size distribution.

6. The method of claim 1, wherein the particulates comprise fibers.

7. The method of claim 1, further comprising creating at least one perforation in a subterranean formation, wherein the fluid is flowed from the wellhead to the perforation, and wherein the packer is formed by squeezing the fluid medium into the formation.

8. The method of claim 1, wherein the fluid is flowed from the wellhead to a position in the wellbore, and wherein the packer is formed by dehydration of the fluid.

9. The method of claim 1, further comprising providing at least one accumulation mechanism for accumulating the particulates, and wherein the bridge-packer forms by settling of the particulates.

10. The method of claim 1, wherein the bridge-packer is a time-release bridge-packer or a degradable bridge-packer is formed.

11. The method of claim 1, wherein in the fluid medium comprises a gas component, a liquid, and surfactant.

12. The method as recited in claim 1, wherein the treatment is any one or more of restimulation, perforation procedures, formation stimulation techniques, acidizing, cementing applications, lost circulation control, or water control.

13. The method of claim 1, wherein the circulating the portion of the fluid in the wellbore occurs while moving the coiled tubing string in the wellbore.

14. The method of claim 1, further comprising exposing the particulates to a degradation factor.

15. The method of claim 14, wherein the factor is time, pH, temperature, hydration, or pressure, or any combination thereof.

16. The method of claim 1, wherein the bridge packer formed further comprises a base.

17. The method of claim 16, wherein the base is selected from the group consisting of alkali metal sulfonates, alkali metal carbonates, alkali metal bicarbonates, alkali metal phosphates, and any mixtures thereof.

18. The method of claim 1, wherein the particulate is a polyacid.

19. The method of claim 18, wherein the polyacid is a polylactic acid.

20. The method of claim 18, wherein the particulates comprise a third amount of particulates with a third average size distribution.

21. The method of claim 18, wherein the polyacid particles comprise solid acid, encapsulated acid, lactic acid, polylactic acid, glycolic acid, polyglycolic acid, or any mixture thereof.

22. The method of claim 18, wherein the polyacid particles comprise encapsulated citric acid, encapsulated lactic acid, encapsulated polylactic acid, encapsulated glycolic acid, encapsulated polyglycolic acid, or any mixture thereof.

23. The method of claim 18, wherein the polyacid particles are in the form of powder, chips, fiber, bead, ribbon, platelet, film, rod, strip, spheroid, toroid, pellet, tablet, capsule, shaving, any round cross-sectional shape, any oval cross-sectional shape, trilobal shape, star shape, flat shape, rectangular shape, cubic, bar shaped, flake, cylindrical shape, filament, thread, or mixtures thereof.

* * * * *